US009115962B1

(12) United States Patent
Weaver

(10) Patent No.: US 9,115,962 B1
(45) Date of Patent: Aug. 25, 2015

(54) BROADHEAD ARROW TIP RELEASE MECHANISM

(71) Applicant: Zachary Weaver, Hummelstown, PA (US)

(72) Inventor: Zachary Weaver, Hummelstown, PA (US)

(73) Assignee: WEAVER'S OUTDOORS, INC., Hummelstown, PA (US)

( * ) Notice: Subject to any disclaimer, the term of this patent is extended or adjusted under 35 U.S.C. 154(b) by 0 days.

(21) Appl. No.: 14/244,636

(22) Filed: Apr. 3, 2014

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | | |
|---|---|---|---|---|
| 3,036,395 | A | 5/1962 | Nelson | |
| 3,036,396 | A | 5/1962 | Swails | |
| 3,138,383 | A * | 6/1964 | McKinzie | 473/583 |
| 3,168,313 | A | 2/1965 | Lint | |
| 4,901,467 | A | 2/1990 | Stolpe | |
| 5,033,220 | A | 7/1991 | Phelps | |
| 5,570,530 | A | 11/1996 | Lee | |
| 6,015,357 | A * | 1/2000 | Rizza | 473/583 |
| 6,217,467 | B1 | 4/2001 | Maleski | |
| 7,485,056 | B2 * | 2/2009 | Sullivan et al. | 473/583 |
| 7,713,151 | B2 | 5/2010 | Fulton | |
| 7,713,152 | B1 | 5/2010 | Tentler et al. | |
| 8,449,415 | B2 * | 5/2013 | Grace | 473/583 |

* cited by examiner

*Primary Examiner* — John Ricci
(74) *Attorney, Agent, or Firm* — Andrew D. Mead

(57) ABSTRACT

A broadhead tip for an arrow having moveable broadhead knives that remain in a first position during flight, extend to a second position when a reverse direction force is applied to the arrow (such as by trying to extract the arrow from the target) that is generally radially oriented to the arrow to prevent removal of the broadhead tip from the target. A barrel stop disposed on the arrow is rotatable between locked and released positions and engages the knives. When locked, the knives are limited to movement between the first and second positions. When released, the knives are permitted to pivot beyond the radial orientation, to a third position approaching 180 degrees from the first position which then allows the knives to swing around so that the broadhead can be removed from the target. Primary use for the broadhead tip is archery fishing.

16 Claims, 7 Drawing Sheets

BROADHEAD ARROW TIP RELEASE MECHANISM

BACKGROUND OF THE INVENTION

The field of invention relates to bowfishing apparatus, and more particularly pertains to a new and improved bowfishing arrowhead wherein the same is arranged for ease of removal subsequent to it being directed through an associated game fish.

Bowfishing is a popular sport and specialty arrowheads have been provided for application to this particular application of fishing. In use of such arrowhead structure, arrowhead structure is provided with blades or barbs that are directed to extend laterally to opposed sides of associated arrowhead to prevent the arrowhead from being easily removed from a game fish, as the game fish is subject to violent gyrations subsequent to its being struck by the associated arrow and the tip that is commonly directed to extend completely through the associated fish. Removal of the arrowhead structure is frequently a problem and results in damage to the fish due to the barb structure projecting therefrom. The instant invention attempts to overcome deficiencies of the prior art by providing moveable barb structure that is easily released for overfolding in a spaced relationship to extend forwardly of the tip in a second position from a first position that extends laterally of the tip to permit ease of removal of the arrowhead minimizing damage to the game fish.

Known arrowheads having provisions for repositioning the barbs to permit release from the game fish are cumbersome to use, typically requiring the use of both hands to effect a barb release. Actuating such a release mechanism to remove an arrow from a game fish that is violently gyrating is difficult at best and often results in extensive damage to the game fish. A mechanism allowing the arrow barbs to be repositioned for easy extraction from the game fish operable with a single hand thereby leaving the fisher's other hand available to hold the fish would provide great benefit to the sport.

SUMMARY OF THE INVENTION

These and other objectives are satisfied by the instant invention, which in one embodiment comprises an arrow tip with a base and a plurality of moveable barbs connected thereto. During flight and impact with the target, the barbs are freely pivotable between a first position in which the barbs are oriented generally adjacent to the arrow shaft trailing the tip and a second position in which the barbs generally radially extend from the arrow. A barrel stop disposed within the base has a first stop profile in contact with each barb adjacent to the pivot location which limits pivotal movement of the barbs between the first and second positions. The barrel stop is selectively rotatable about the arrow longitudinal axis to bring a second stop profile in contact with the barbs. The second stop profile allows the barbs to swing beyond the second stop position to a third position in which the barbs are oriented approximately 180 degrees from the first position.

In another embodiment of the present invention, an arrow tip comprising a base, a rotatable barrel stop, and a plurality of moveable barbs connected thereto is provided. The rotatable barrel stop includes at least two stop profiles which engage the swingable barbs to control movement of the barbs. A first stop position limits swinging movement of the barbs between a first position in which the barbs are trailingly aligned from the tip as during arrow flight and a second position in which the barbs are allowed to extend to a position generally radially oriented to the arrow to prevent the arrow tip from disengaging an impacted target. Rotating the barrel stop to a second stop position releases the swingable barbs and allows movement of the barbs to a third position in which the barbs are oriented approximately 180 degrees from the first position which allows the arrow tip to be extracted from an impacted target. A locking member retains the rotating barrel in the first position. The locking member includes a biasing element which allows rotation of the barrel stop by overcoming the biasing force.

The easily releasable arrow tip comprising a base portion having a plurality of moveable barbs connected thereto, and a rotatable barrel stop having a locking surface and a release surface which interacts with the moveable barbs to selectively limit the movement of the barbs when the locking surface is aligned with the barbs, and to allow unimpeded movement of the barbs when the release surface is aligned with the barbs, selection of the locking or release surface accomplished by rotating the barrel stop in relation to the base portion. A spring biased detent mechanism maintains the barrel stop positioned for locking alignment or releasing alignment once so positioned and further enables disassembly of the arrow tip. The arrow tip is durable in construction, inexpensive of manufacture, carefree of maintenance, easily assembled, and simple and effective to use.

Additional advantages and objectives of various aspects and embodiments of the present invention are discussed below.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Figure 1:
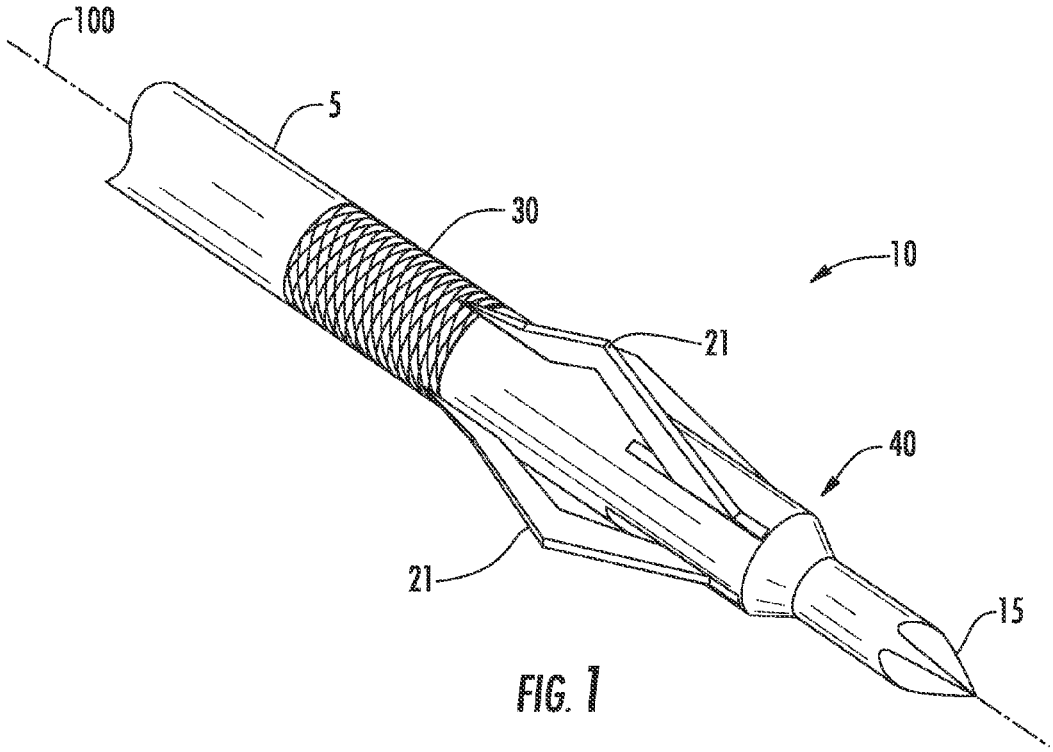
FIG. 1 is a perspective view of an arrow having an arrow tip embodying aspects of the present invention shown configured for arrow flight.

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "left" or "right," "forward" or "rearward" are used as a matter of mere convenience, and are determined from the rear of the arrow facing the normal direction of travel. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures. Alpha designations following a numeric designator are used to distinguish the two similar parts, typically right side/left side on the generally symmetrical invention; reference to the numeric designator alone indicates the either part.

Referring to the figures, there is shown an arrow tip 10 for mounting on one end of an arrow shaft 5. The arrow tip illustrated is of the type generally used for archery fishing in which a fish is impaled by the arrow. Moveable barbs extend outwardly, either upon impact with the fish or once the arrow tip has passed through the fish to prevent reverse extraction of the arrow tip. A cord attached to the arrow may then be used to retrieve the fish. Such arrow tips are well-known in the art. While an exemplary archery arrow is used to describe the present invention, the invention may also find utility in other similar applications, such as spear fishing, which benefit of an easily releasable broadhead arrow tip.

The arrow tip 10 includes a barb core 30, a plurality of moveable knives or barbs 21 which are coupled to a barb retainer 40. The barb retainer 40 is coupled to the barb core 30 in a manner permitting limited rotational movement about the longitudinal axis 100 of the arrow and barb core. As best illustrated in FIGS. 4 through 8, the bar core 30 includes a cylindrical bearing surface 36 which engages a mating surface 46 in the barb retainer 40. Sizing of the respective diameters of the surfaces 36, 46 is configured to permit rotational movement without undue free play. In one embodiment, the bearing surface 36 diameter is nominally 0.002-inch smaller than the inner diameter of mating surface 46 with a permissible range of 0.001 to 0.004 inches.

A point 15 may be provided to streamline the forward end of the tip. As illustrated, the point 15 is selectively removable from the arrow tip 10 to allow for replacement of a dulled point, such as one that has impacted a stone.

While shown with three barbs, the present invention is useful for any number of barbs that may be desired, though best arrow performance is achieved with two to four barbs radially positioned symmetrically about the barb retainer.

The barbs 21 are preferably pivotally connected to the barb retainer 40 by hinge pins 22 which are received in pin bores 42 in the barb retainer 40. The barb retainer 40 is provided with a plurality of slotted apertures 44 equal in number to the plurality of barbs 21 through which the distal ends of the barbs 21 project. The slotted apertures 44 are of sufficient dimension to allow pivoting movement of the barbs 21 between a first, fully retracted trailing position (position shown in FIG. 1), a second, extended position (position shown in FIG. 2), and a third, released position (position shown in FIG. 3) without interfering with movement of the barbs 21. The proximal ends of the barbs 21 are connected by the hinge pins 22 to the barb retainer 40. Each barb 21 further includes a follower surface 212 adjacent to the proximal end.

The core 30 comprises a base profile 35 which is configured to interact with the follower surface 212 of each barb 21 to limit pivotal movement thereof to movement between the first and second positions. The core 30 also includes a release profile 37 which, when aligned with the follower surfaces 212, allows the barbs 21 to pivot between at least the second and third positions. In one embodiment, the release profile 37 is configured as a slot-like channel in the base profile 35 that allows unimpeded movement of the follower surface 212 and thus pivotal movement of the barbs 21 between the retracted position in which the distal ends of the barbs trail the pivots and are barbs are generally adjacent to the arrow shaft, and the released position, in which the distal ends barbs lead the pivots and the barbs are a pivoted range of approximately 180 degrees from the first position. The release profile slots 37 are radially spaced to match locations of the barbs 21 so that the barbs are released only when the barb retainer 40 is rotated into proper alignment with the release profile slots 37, referred to as the release or unlock position. Rotating the barb retainer 40 relative to the core 30 away from the releasing alignment positions the follower surfaces 212 adjacent to the base profile 35 and thereby limits pivoting movement of the barbs 21 to between the first and second positions, referred to as the locked position.

Figure 9:
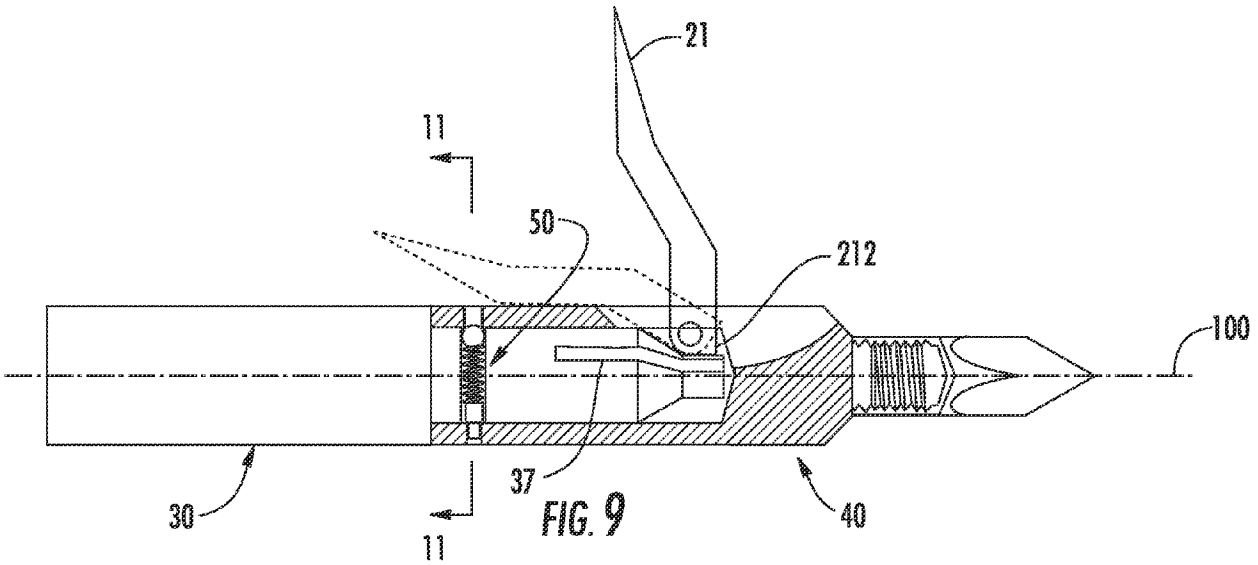
FIG. 9 is a longitudinal section view of the arrow tip showing the mechanism for limiting swinging movement of the attached blades.
Figure 11:
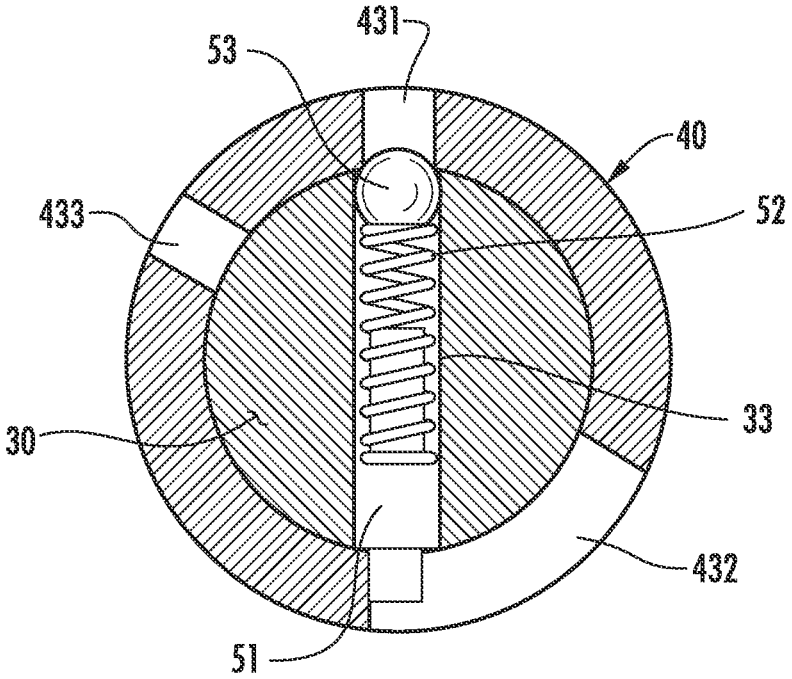
FIG. 11 is a section view of the arrow tip as positioned in FIG. 9 taken along cut line 11-11.
Figure 12:
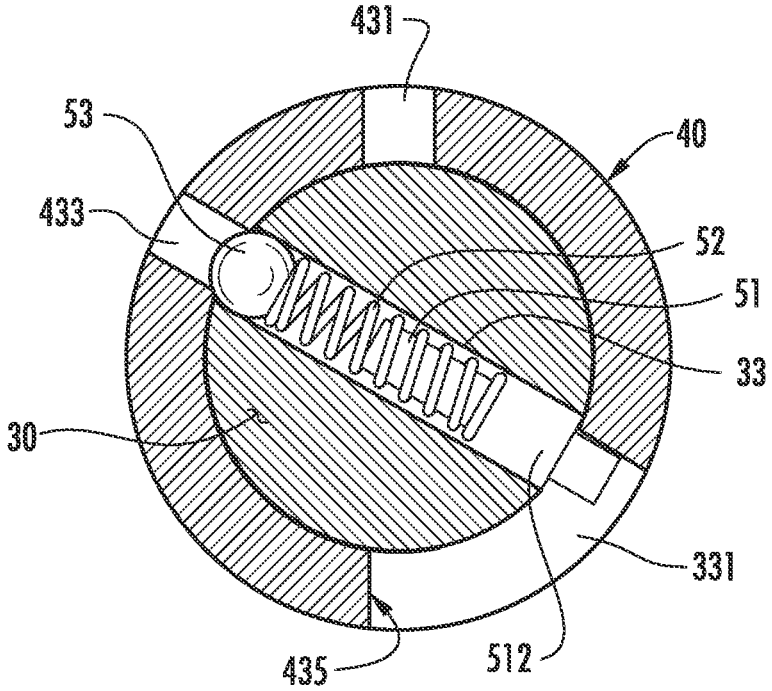
FIG. 12 is a section view of the arrow tip as positioned in FIG. 10 taken along cut line 12-12.

Rotation of the barb retainer 40 in relation to the core 30 is limited by a detent device 50 to define generally opposing locked and release positions (see FIGS. 9, 11 (locked) and 10, 12 (released)). The detent device 50 further allows the barb retainer 40 and core to be maintained in a pre-determined rotational relationship, but moved by simply applying a torque to the arrow shaft that is sufficient to overcome the detent mechanism. The detent device 50 comprises a detent bore 33 in the core portion 30 which contains a stop pin 51, a ball 53, and a spring 52. A travel stop slot 432 and one or more detent receptacles 431, 433 are provided in the barb retainer 40 and axially aligned with the detent bore 33 when the arrow tip is assembled. Radial positioning of the detent receptacles 431, 433 corresponds to the rotational positions permitted by the travel stop slot 432 so that the arrow tip will tend to remain positioned at the extremes rather than freely rotating, especially during arrow flight. A stop extension 514 on the stop pin 51 engages the stop slot 432 and establishes a range that the barb retainer may rotate relative to the core by contact with the ends 435, 436 of the stop slot 435. Such rotation must necessarily be limited to less than the radial spacing of the barbs. For example, three barbs would be radially spaced at 120 degree intervals around the barb retainer. Corresponding release profile slots 37 would also be spaced at 120 degree positions about the core portion. The rotational limit established by the stop slot would necessarily be less than 120 degrees, with a rotational limit of 90 degrees or less being most practical and a rotational limit of 60 degrees being preferred. A smaller rotational range improves the ability for a user to release the barbs and extract the arrowhead from a fish using only one hand, leaving the other hand to hold the fish.

The spring 52 is compressed between the ball 53 and a shoulder 512 of the stop pin 51 to force each outwardly of the bore 33. The width of the stop slot 432 is less than the diameter of the shoulder 512 of the stop pin to keep the stop pin 51 captured in the detent bore 33. The spring 52 also pushes the ball 53 outwardly into contact with the inner bore 46 of the barb retainer 40. The ball 53 is pushed into engagement with the detent receptacle 431, preferably when the barb retainer 40 is rotated to the normal arrow flight position (limiting barb movement between the first and second positions) to maintain the arrow tip properly configured for flight and impact with a target. If a second detent receptacle 433 is provided, the ball 53 engages the second detent receptacle 433 when the arrow tip is configured to release the barbs 21 (see FIG. 3, 10). A user may then rotate the core 30 relative to the barb retainer 40 by applying sufficient rotational torque to overcome the spring biasing force to drive the ball 53 into the detent bore 33 and allow the core and barb retainer to be rotated. The detent receptacle(s) may be a through-hole having a diameter smaller than the diameter of the ball, or a semi-spherical recess in the interior wall of the barb retainer into which a portion of the ball may be received. Relative sizing of the detent recess and ball to achieve a desired release torque is well-established practice in biased detent mechanisms and not discussed in further detail. The object of the detent is to maintain the barb retainer 40 aligned in either the locked position for flight or the released position as for removing the arrow tip from a target.

By configuring the detent device 50 with a compressed length that is less than the diameter of the core 30 where the detent bore 33 is located, the detent device 50 may also be used to assemble/disassemble the arrow tip 10. Compressing the spring 52 so that the entire stop pin 51, ball 53, and spring 52 are disposed within the detent bore allows the barb retainer 40 to be moved axially into/out of engagement with the core portion 30. One benefit to this arrangement is that multiple barb retainers perhaps featuring alternate barb configurations could be easily fitted onto an arrow tip.

Figure 2:
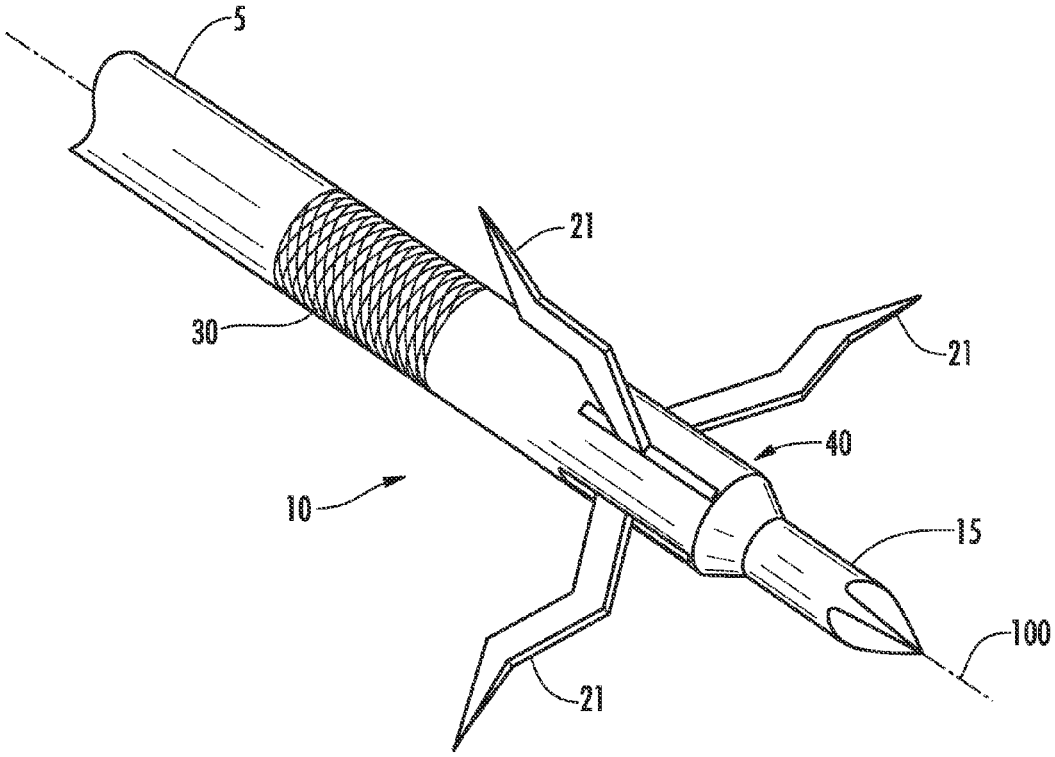
FIG. 2 is a perspective view of the arrow tip of FIG. 1 shown configured to prevent extraction of the arrow tip from a target.
Figure 3:
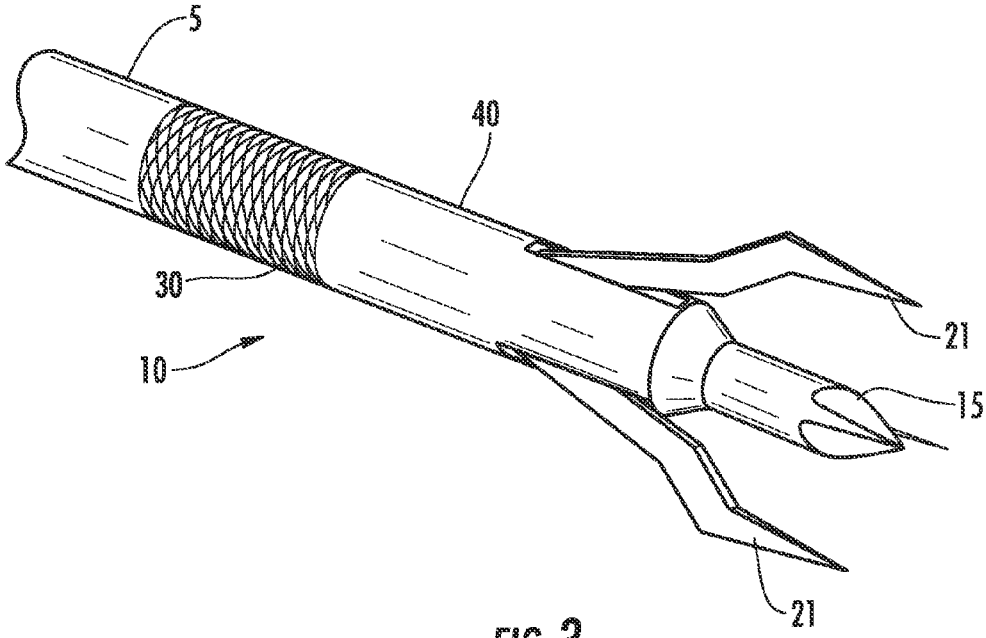
FIG. 3 is a perspective view of the arrow tip of FIG. 1 shown configured to allow extraction of the arrow tip from a target.
Figure 4:
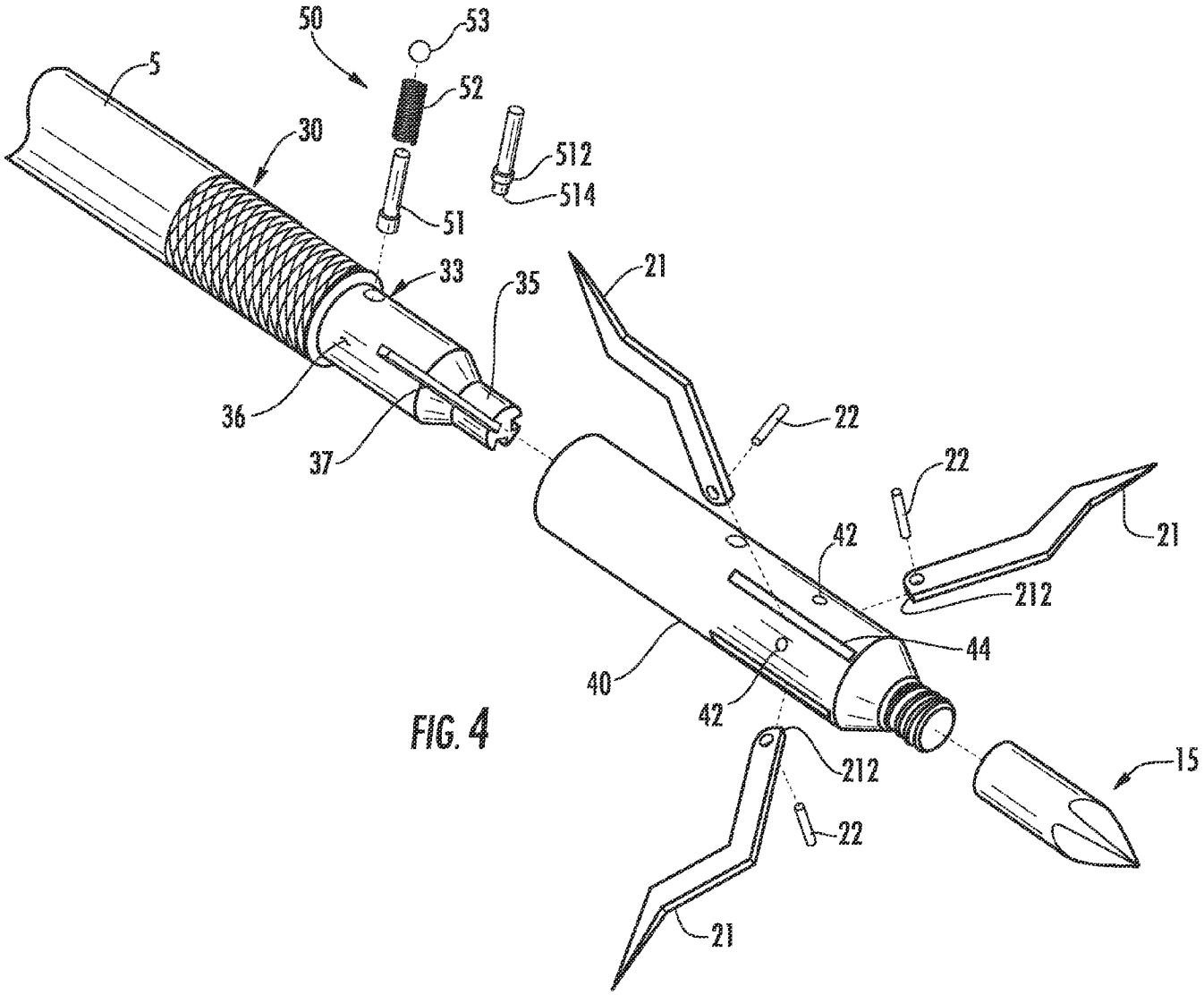
FIG. 4 is an exploded view of the arrow tip of FIG. 1.
Figure 6:
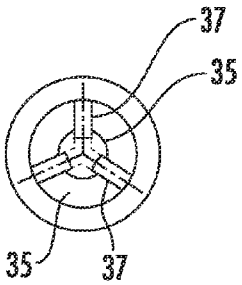
FIG. 6 is a section view of the core portion shown in FIG. 5 taken along cut line 6-6.
Figure 8:
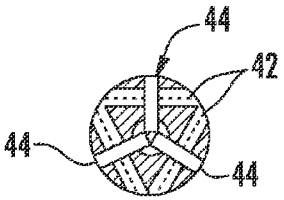
FIG. 8 is a section view of the barb retainer portion shown in FIG. 7 taken along cut line 8-8.
Figure 5:
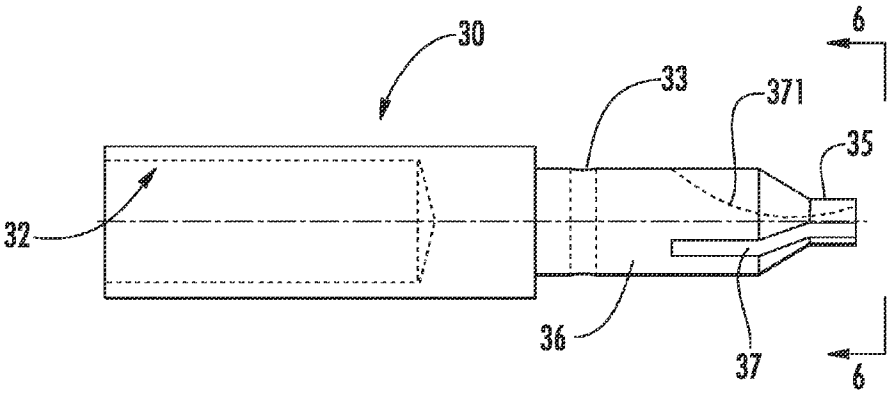
FIG. 5 is an elevation view of the core portion of the arrow tip of FIG. 4.
Figure 7:
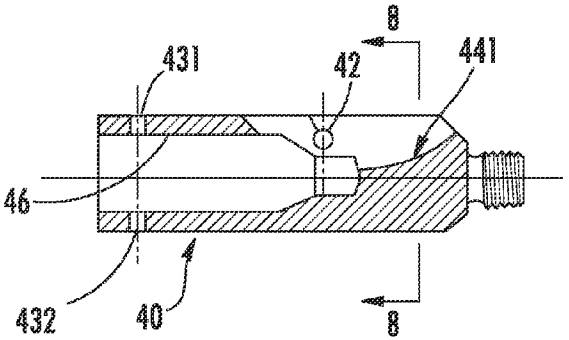
FIG. 7 is an elevation view of the barb retainer portion of the arrow tip of FIG. 4.
Figure 10:
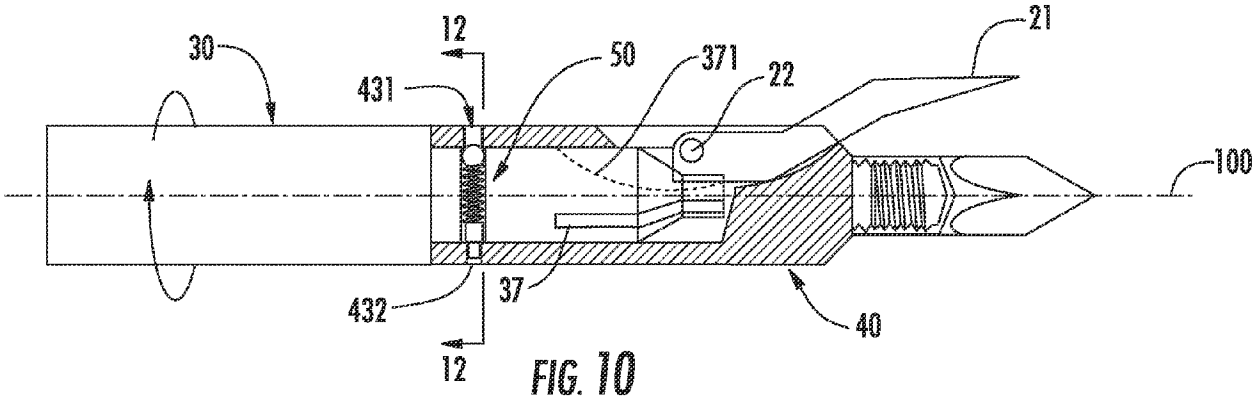
FIG. 10 is a longitudinal section view of the arrow tip showing the mechanism for limiting swinging movement of the attached blades in a second position which allows additional range of swinging movement.

In use, the arrow tip is normally positioned so that the barbs 21 are limited to movement between the first (see FIG. 1) and second positions (see FIG. 2). During flight and upon impact with the target, the barbs tend to trail the tip (first position). Upon pulling the arrow in a reverse direction to normal flight, the barbs are extended outwardly as shown in FIG. 2. The radially extending barbs prevent the arrow tip from being removed from the target absent great force. To remove the arrow from the target, a user need only rotate the arrow shaft 5 and connected core portion 30 from the locked position (FIG. 9) to the released position (see rotation arrow in FIG. 10) thereby allowing the barbs 21 to pivot forwardly (FIG. 3) so that the arrow may be pulled from the target. Rotation of the arrow to release the barbs is easily accomplished with one hand as the target (fish) is held with the other, significantly simplifying the process of extracting an arrow from a target fish.

Naturally, the invention is not limited to the foregoing embodiments, but it can also be modified in many ways without departing from the basic concepts. It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

I claim:

1. A tip for an arrow comprising:

a core portion;

a retainer portion having a plurality of swingable blades each with a proximal end pivotally connected to the retainer portion, each blade swingable between generally opposing first and second positions, the retainer portion being rotatable in relation to the core portion and rotatable about a longitudinal axis of the arrow to at least a locked position and released position; and a locking member to restrain the retainer portion in at least one preferred position;

the core portion further including a stops surface engaging the blades to prevent movement toward the second position from an intermediate position between the first and second positions when the retainer portion is in the locked position, the core portion further including a release surface that allows the plurality of swingable blades to move freely between the first and second positions when the retainer portion is in the released position.

2. The tip of claim 1, wherein the locking member comprises a spring biased detent positioner disposed in a transverse aperture in the core portion, the detent positioner engaging one or more detent receptacles in the retainer portion to restrain the retainer portion in the at least one preferred position.

3. The tip of claim 1, wherein each of the plurality of swingable blades includes a follower surface adjacent to the pivotal connection, the follower surface contacting the stop surface when the blade is in the intermediate position and the retainer portion is in the locked position to prevent movement toward the second position.

4. The tip of claim 3, wherein the plurality of blades is symmetrically arranged radially about the longitudinal axis of the arrow and each blade pivots about pivot axes that are generally transverse to the longitudinal axis.

5. The tip of claim 4, wherein the retainer portion rotation relative to the core portion when rotating between the locked and released positions is less than the radial spacing between adjacent blades.

6. The tip of claim 5, wherein each of the plurality of blades is trailingly oriented when in the first position, pivoted approximately 180 to a leading orientation when in the second position, and generally radially extended from the longitudinal axis when in the intermediate position.

7. The tip of claim 1, wherein the release surface is a plurality of channels in the stop surface equal in number to the number of blades and follower surfaces, each channels configured to permit pivotal movement of the respective follower surface as the blades.

8. The tip of claim 1, wherein the at least one preferred position includes the locked position.

9. The tip of claim 1, wherein the at least one preferred position includes the released position.

10. An arrowhead for mounting at a leading end of an elongate arrow shaft comprising:

a core portion disposed along a longitudinal axis of the arrow shaft;

a retainer portion rotatably connected to the core portion and disposed along the longitudinal axis, the retainer portion having a plurality of swingable blades each having a proximal end that is pivotally connected to the retainer portion, the retainer portion being rotatable in relation to the core portion and rotatable to at least a locked position and released position, each blade further having a distal end that moves through an arc between generally opposing first and second positions wherein the distal ends are rearward of the pivot connections when in the first position and forward of the pivot connections when in the second position; and a locking member to restrain the retainer portion in at least one preferred position;

the core portion further including a stops surface engaging the blades to prevent movement toward the second position from an intermediate position between the first and second positions when the retainer portion is in the locked position wherein each of the blades extend generally radially from the longitudinal axis, the core portion further including a release surface that allows the plurality of swingable blades to move freely between the first and second positions when the retainer portion is in the released position.

11. The arrowhead of claim 10, wherein the locking member comprises a spring biased detent positioner disposed in a transverse aperture in the core portion, the detent positioner engaging one or more detent receptacles in the retainer portion to restrain the retainer portion in the at least one preferred position.

12. The arrowhead of claim 10, wherein the at least one preferred position includes the locked position.

13. The arrowhead of claim 10, wherein the at least one preferred position includes the released position.

14. The arrowhead of claim 10, wherein each of the plurality of swingable blades includes a follower surface adjacent to the pivotal connection, the follower surface contacting the stop surface when the blade is in the intermediate position and the retainer portion is in the locked position to prevent movement toward the second position.

15. The arrowhead of claim 14, wherein the plurality of blades is symmetrically arranged radially about the longitudinal axis of the arrow and each blade pivots about pivot axes that are generally transverse to the longitudinal axis.

16. The arrowhead of claim 15, wherein the retainer portion rotation relative to the core portion when rotating between the locked and released positions is less than the radial spacing between adjacent blades.

* * * * *